United States Patent [19]

Everett et al.

[11] Patent Number: 4,833,998

[45] Date of Patent: May 30, 1989

[54] COLLAPSIBLE TABLE WITH FOLDABLE LEG BRACES HELD STRAIGHT BY CABLES WHEN TOP IS OPEN

[76] Inventors: James E. Everett, 429 Olive St., Santa Rosa, Calif. 95407; Michael J. Tuhtan, 1265 Cunningham Rd., Sebastopol, Calif. 95472

[21] Appl. No.: 150,516

[22] Filed: Feb. 9, 1988

[51] Int. Cl.[4] ..... A47B 3/00

[52] U.S. Cl. ..... 108/36; 108/132

[58] Field of Search ..... 108/36, 131, 133, 132, 108/129, 35, 153, 128, 36; 248/108.6, 188.91; 24/114.5

[56] References Cited

U.S. PATENT DOCUMENTS

| | | | |
|---|---|---|---|
| 1,170,977 | 2/1916 | König | 108/36 |
| 1,181,320 | 5/1916 | Korn | 108/36 |
| 1,455,066 | 5/1923 | Bereman | 108/35 |
| 1,530,726 | 3/1925 | Koenigkramer | 108/35 |
| 1,633,727 | 6/1927 | Early | 24/114.5 |
| 1,684,653 | 9/1928 | Willett | 108/35 |
| 2,167,342 | 7/1939 | York | 108/35 |
| 2,283,020 | 5/1942 | Sunderland | 24/114.5 |
| 2,516,235 | 7/1950 | Morgan | 108/35 |
| 2,533,787 | 12/1950 | Gebhart | 108/36 X |
| 2,559,357 | 6/1951 | Holt, Jr. | 108/35 |
| 2,637,084 | 5/1953 | Lorentzen | 24/114.5 |
| 2,673,774 | 3/1954 | Di Prima | 108/36 |
| 4,333,638 | 6/1982 | Gillotti | 108/36 X |
| 4,354,437 | 10/1982 | Logan | 248/188.9 K |

FOREIGN PATENT DOCUMENTS

| | | | |
|---|---|---|---|
| 674214 | 3/1939 | Fed. Rep. of Germany | 248/188.1 |
| 400752 | 8/1909 | France | 108/36 |
| 748608 | 7/1933 | France | 248/188.1 |
| 325399 | 11/1957 | Switzerland | 108/36 |

*Primary Examiner*—Kenneth J. Dorner
*Assistant Examiner*—José V. Chen
*Attorney, Agent, or Firm*—David Pressman

[57] ABSTRACT

A collapsible table, especially suited for supporting persons to be massaged, comprises, in a main embodiment, a pair of hingedly-connected top sections (12) and two pairs of legs (16) hingedly connected to the respective outer ends of the top sections. A foldable leg brace (18) is connected between the side of the table's top at its center and a lower part of each leg. A brace crosspiece (32) interconnects each pair of braces. A pair of short cable support legs (26) extend down from the center of the table. Each of a pair of cables (28) extends in a V-shaped arrangement from near the leg hinges at one end of the table down through holes in the brace crosspieces to the bottom ends of the cable support legs and then up through the other brace cross piece to the leg hinges at the opposite end of the table. Each cable has a stop (10) fixedly attached thereto just above the place where the cable passes through its brace crosspiece, the stop preferably comprising a sleeve (34) crimped to the cable and a helical spring (38) between the crimped sleeve and the crosspiece. The cable stops prevent the leg braces from being folded up unless the cables are first slackened by folding the two top sections of the table together. However since the top sections can't be folded together while the table is upright, especially if weight is on the table, the table's braces and legs are locked when it is upright. In other embodiment, the cable extends directly between leg braces (FIG. 2), legs per se (FIG. 3), or around splayed legs (FIG. 4) to provide an automatic leg, or leg brace, locking feature. In still other embodiments an improved face cradle (FIG. 5A) is provided which comprises a plate (82), one end of which has a hinged connection (90, 98) to the table top, and which includes a support arm (92) hingedly connected (94) to an underside of the plate and adjustably connected (106) to an underside of the table, either by a slot (96) or by a plurality of holes (128, FIG. 7C). The table can have an adjustable leg (FIG. 6A) comprising two sections (110, 112) which are keyed together (114) and which are separated by spaced pads (116) and bolted together between the pads (122). The legs (FIG. 8A, 144) can alternatively be hinged to the underside of the table's top (142) and supported in open position by a pair of hinged brace arms (146), the ends of which are removably joinable to the the legs, respectively, at locations spaced from the ends of the legs by pin-in-hole (156, 160) and multiple hook and loop fasteners (154, 158).

9 Claims, 11 Drawing Sheets

COLLAPSIBLE TABLE WITH FOLDABLE LEG BRACES HELD STRAIGHT BY CABLES WHEN TOP IS OPEN

BACKGROUND

1. Field of the Invention

This invention relates to tables, particularly to a collapsible table useful for supporting a person being massaged.

2. Description of Prior Art

Heretofore collapsible tables of the type which had to bear relatively great loads, such as massage tables, were made in a variety of shapes and styles. One popular type used load-bearing cables to support the table and bear most of its weight when it was assembled. Such tables usually had foldable diagonal leg braces to hold the legs in their unfolded, open condition, at right angles to the table's top. For safety purposes, these braces were themselves usually locked in an unfolded straight condition by means of various locking devices, such as pins, special latches, and the like.

Such locking devices had many inherent disadvantages. A main disadvantage with locking pins and the like was that they had to be specially inserted or set in place by a separate manual operation. If the user forgot to perform this operation, the stability and the safety of the table was compromised and it could collapse if kicked or hit in the wrong way. The pins could sometimes be inserted improperly, e.g., partially, so that they did not latch, leading to compromises in safety. Also if the pins became worn, their fit became loose and they again tended to disengage. A main disadvantage with latches is that they also had to be set manually, or, if automatic, were heavy, complicated, unreliable, and expensive.

Another type of table used rigid, foldable braces or struts to lock the table's legs in open position. However these struts were expensive to manufacture, were subject to collapse, were heavy, and were unreliable in operation.

In addition to the foregoing disadvantages associated with the table's support mechanism, other disadvantages were encountered with the face cradle arrangements employed in massage tables. As is known, when a person receives a massage in a prone (front part of body down) position, such person's head is usually supported by a face cradle, a padded arrangement which allows the person to breathe while the person faces down. Heretofore such face cradles were difficult to assemble to the table and were not adjustable so that the person's head could be raised or lowered.

The table's leg adjustment mechanisms also left much to be desired. Heretofore the height of most tables was not adjustable, or could be adjusted only by unbolting and then rebolting two-part sliding legs. Obviously this process was complicated, time consuming, and could not be performed by those who did not have tools or were not mechanically minded.

OBJECTS AND ADVANTAGES

Accordingly, several objects and advantages of the invention are to provide a collapsible table with cable supports and leg locking braces with increased safety and security, lower cost, less weight, increased reliability, greater simplicity, etc. Another object and advantage is to provide such a table with an improved and automatic leg brace locking feature. Other objects are to provide several new and improved designs for collapsible tables with automatic brace locking features.

Additional objects and advantages are to provide a table with an improved strut arrangement which is reliable, economical, easy to use, and light in weight.

Further objects and advantages are to provide an improved face cradle mechanism which is simple in construction, light in weight, easy to use, and which can be adjusted to support the massaged person's neck in a variety of positions.

Still further objects and advantages are to provide an improved table height adjustment mechanism which is economical, reliable, and easy and quick to use.

Further objects and advantages will become apparent from a consideration of the ensuing description and accompanying drawings.

DRAWING FIGURES

FIG. 1 E is a bottom perspective view of the VCA table.

Figure 1A:
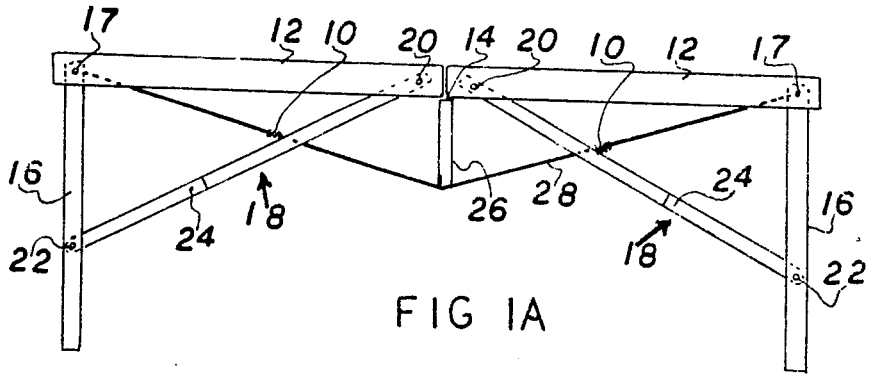
FIG. 1A is a side diagrammatic view of a massage table with a V-cradle arrangement (VCA) according to the invention.
Figure 1B:
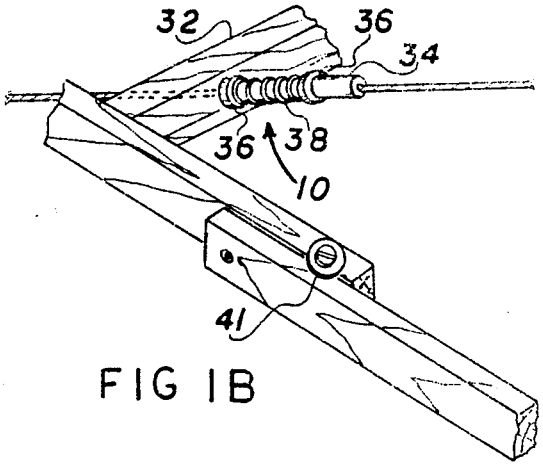
FIG. 1B is a perspective view of the automatic cable locking arrangement of the VCA table.
Figure 1C:
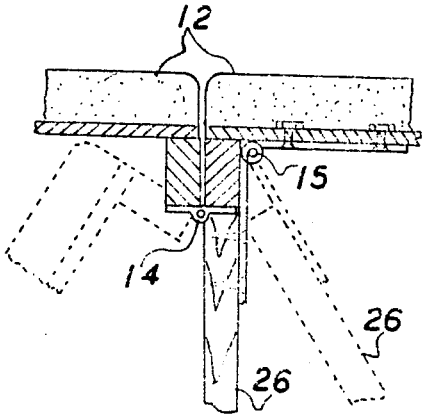
FIG. 1C is a side sectional view of the top hinge section of the VCA table.
Figure 1D:
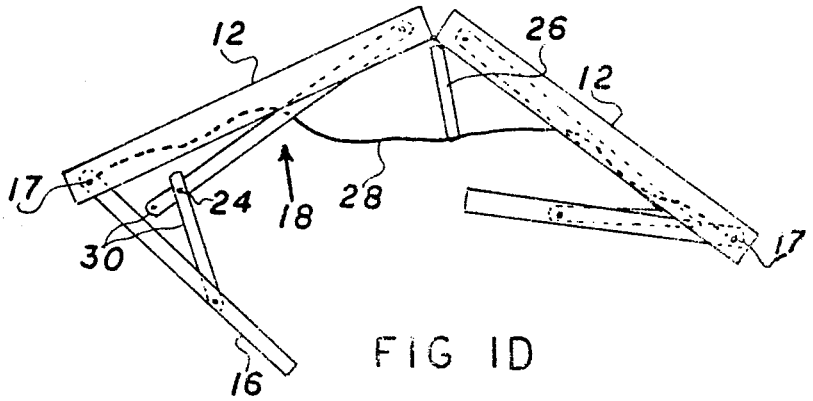
FIG. 1D is a side diagrammatic view of the VCA table in partially collapsed condition.
Figure 1E:
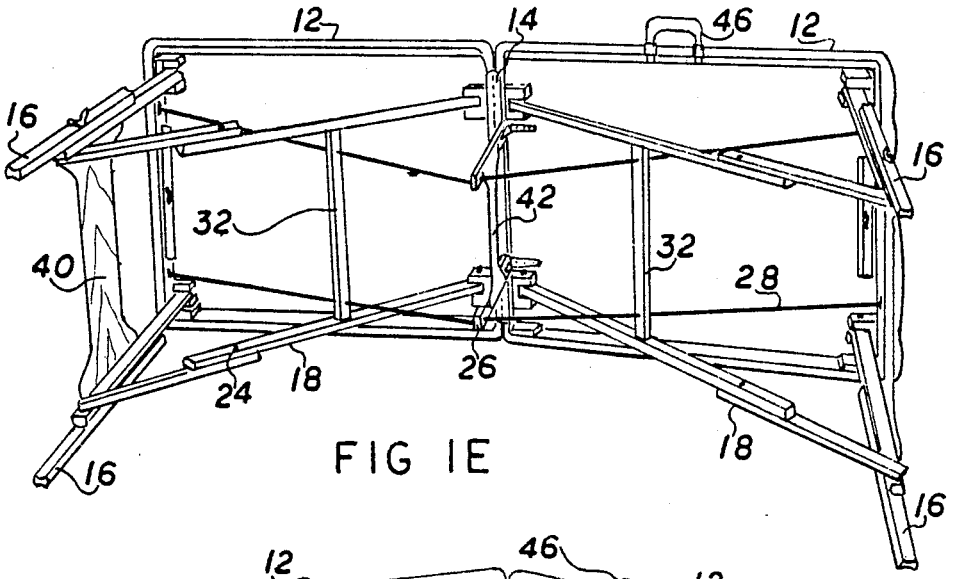
Figure 1F:
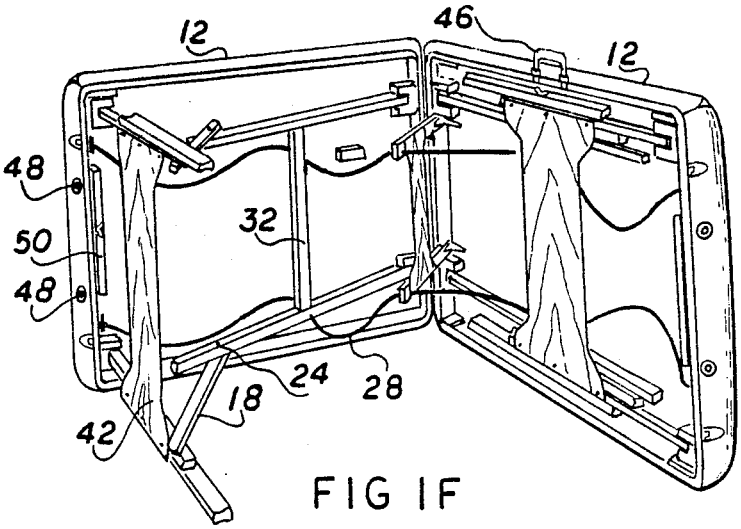

FIG. 1F is a bottom view with the VCA table partially collapsed.

Figure 1G:
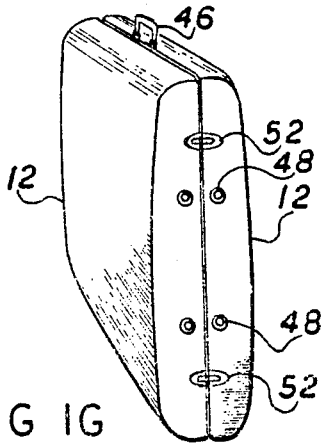

FIG. 1G is a perspective view of the VCA table fully collapsed.

Figure 1H:
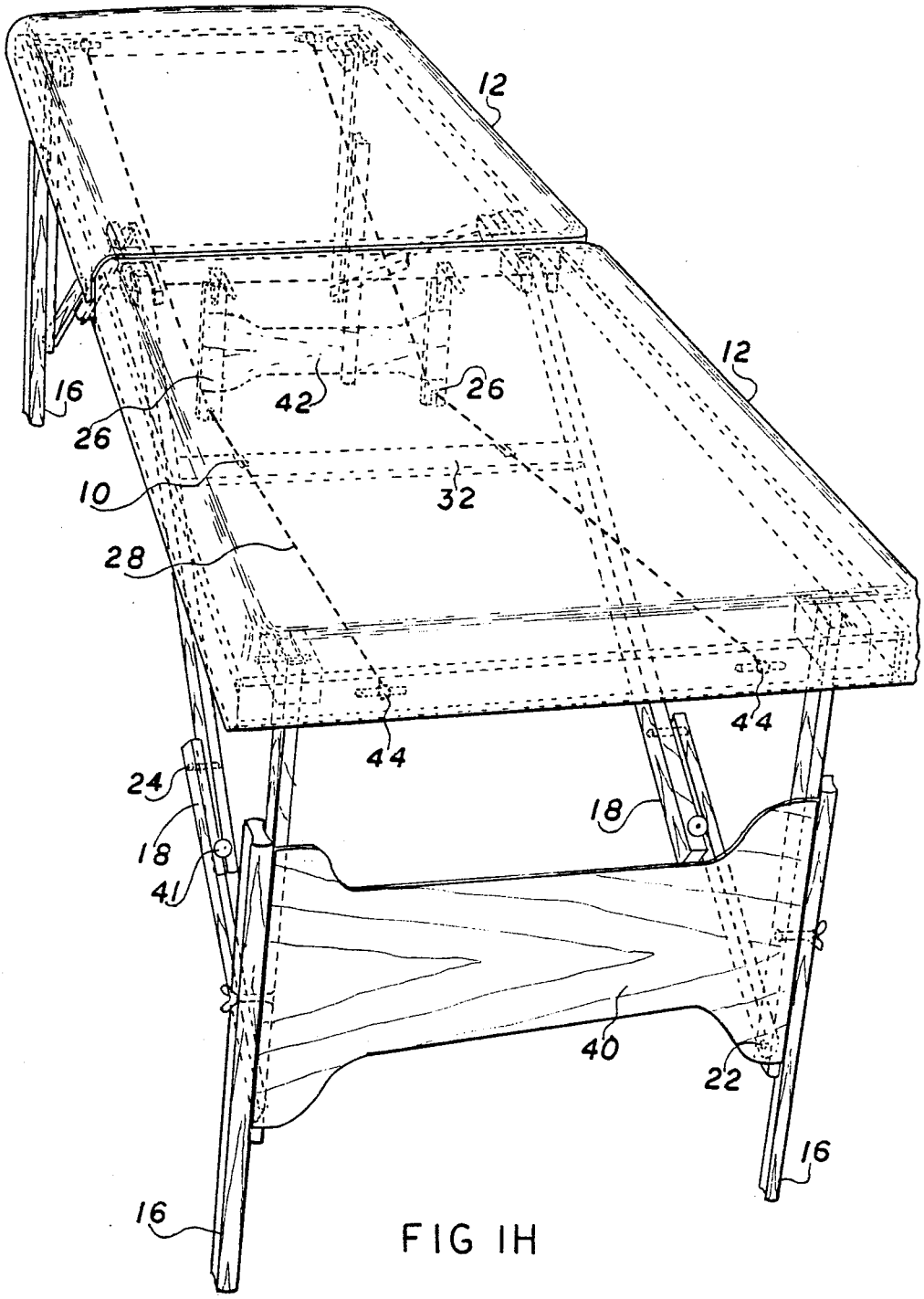

FIG. 1H is a top perspective view, partially in phantom, of the VCA table.

Figure 2A:
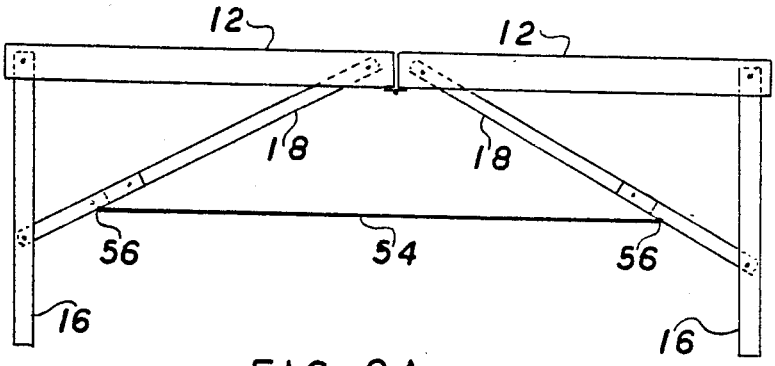

FIG. 2A is a side diagrammatic view of alternative table with a horizontal cable on brace arrangement (HCBA) according to the invention.

Figure 2B:
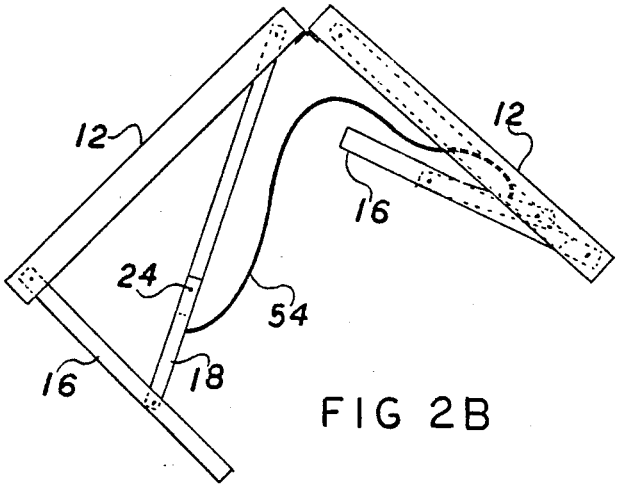

FIG. 2B is a side diagrammatic view of the HCBA table in partially collapsed condition.

Figure 2C:
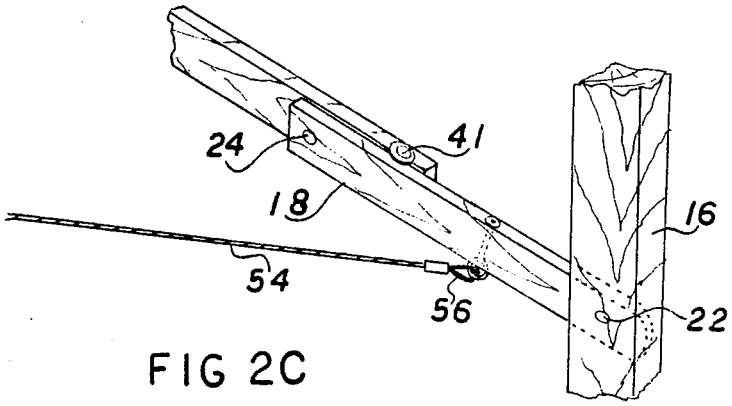

FIG. 2C is a perspective view of the cable anchor and brace arrangement of the HCBA table.

Figure 3A:
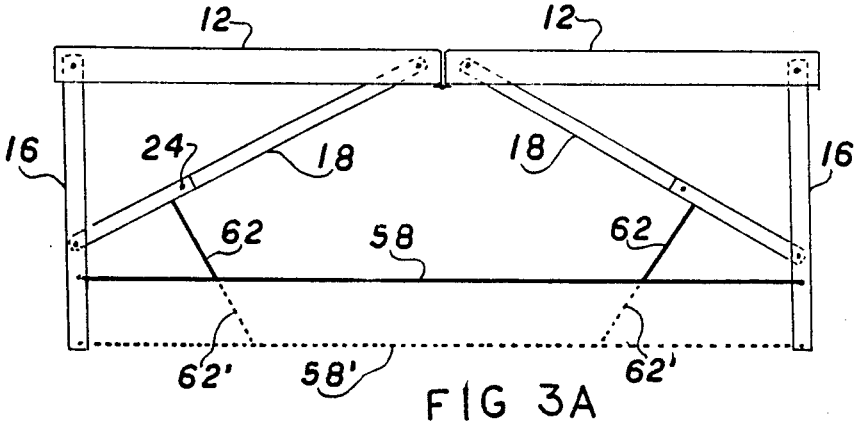

FIG. 3A is a side diagrammatic view of an alternative table with a horizontal cable on leg arrangement (HCLA) according to the invention.

Figure 3B:
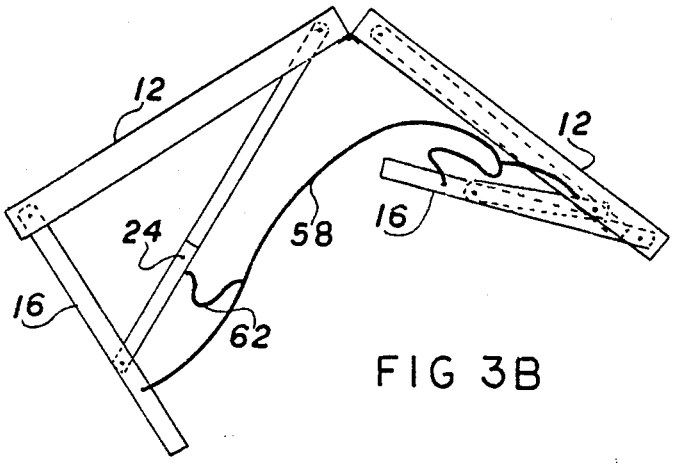

FIG. 3B is a side diagrammatic view of the HCLA table in partially collapsed condition.

Figure 3C:
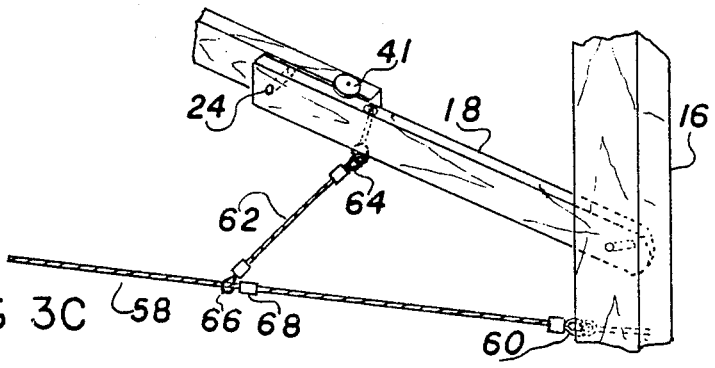

FIG. 3C is a perspective view of the cable anchor and brace arrangement of the HCA table.

Figure 4A:
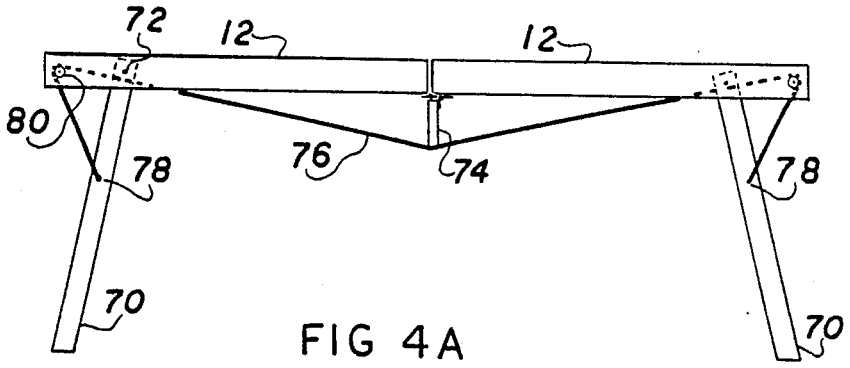

FIG. 4A is a side diagrammatic view of a alternative table with a spread-leg arrangement (SLA) according to the invention.

Figure 4B:
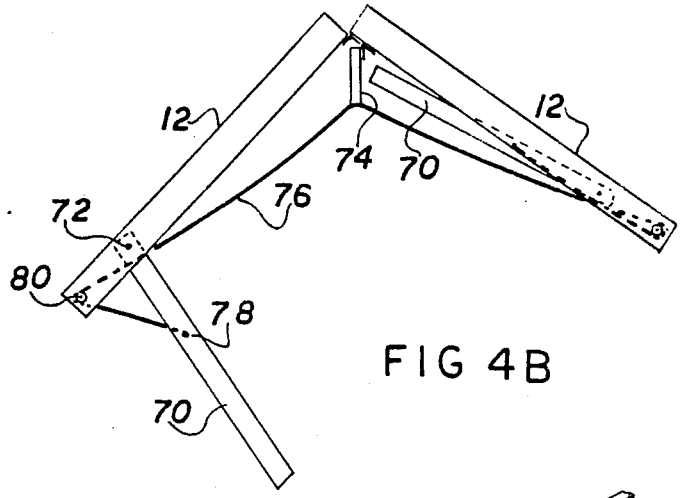

FIG. 4B is a side diagrammatic view of the SLA table, partially collapsed.

Figure 4C:
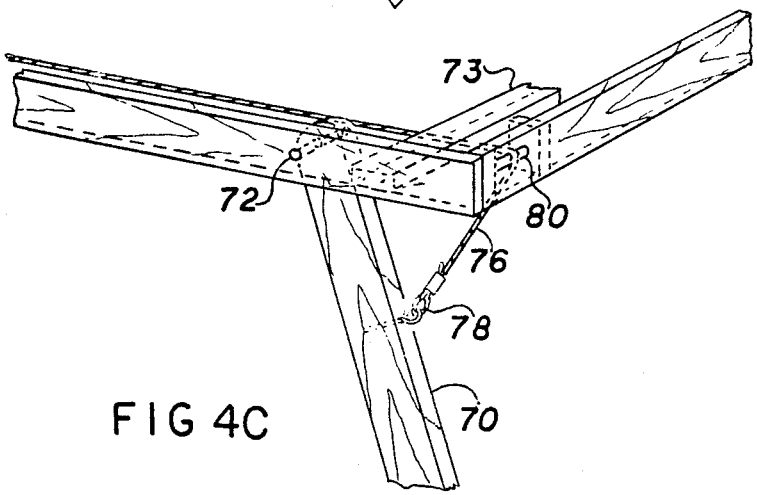

FIG. 4C is a perspective view of the cable pulley part of the SLA table.

Figure 5A:
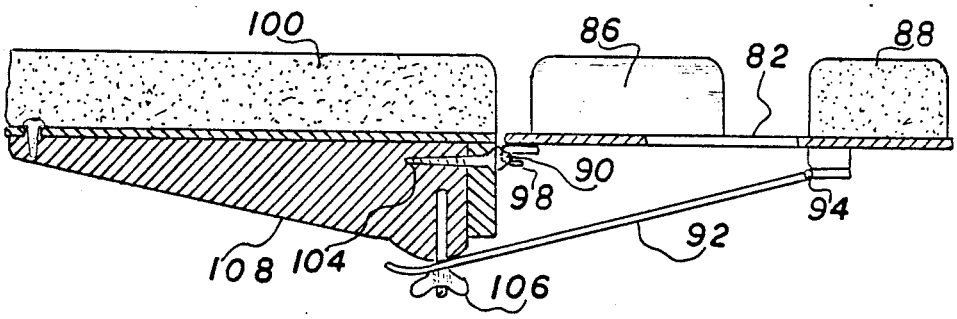

FIG. 5A is a side cross-sectional view of a hinged face cradle according to the invention. This arrangement employs a thumbscrew and slotted arm locking mechanism.

Figure 5B:
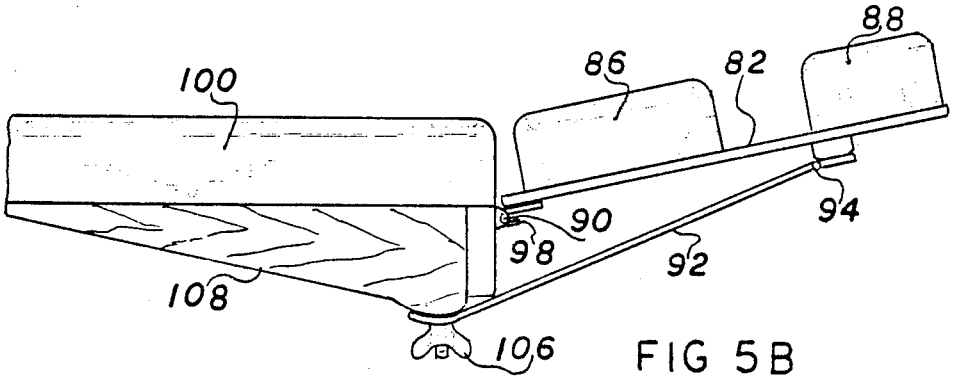

FIG. 5B is a side view showing the face cradle in a partially raised position.

Figure 5C:
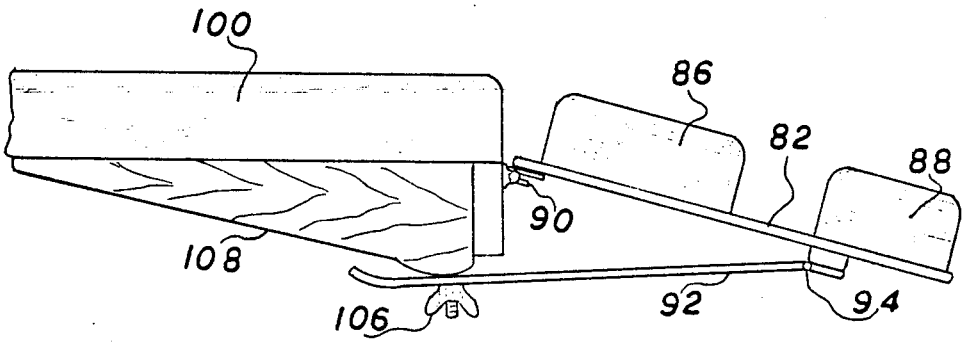

FIG. 5C is a side view showing the face cradle in a partially lowered position.

Figure 5D:
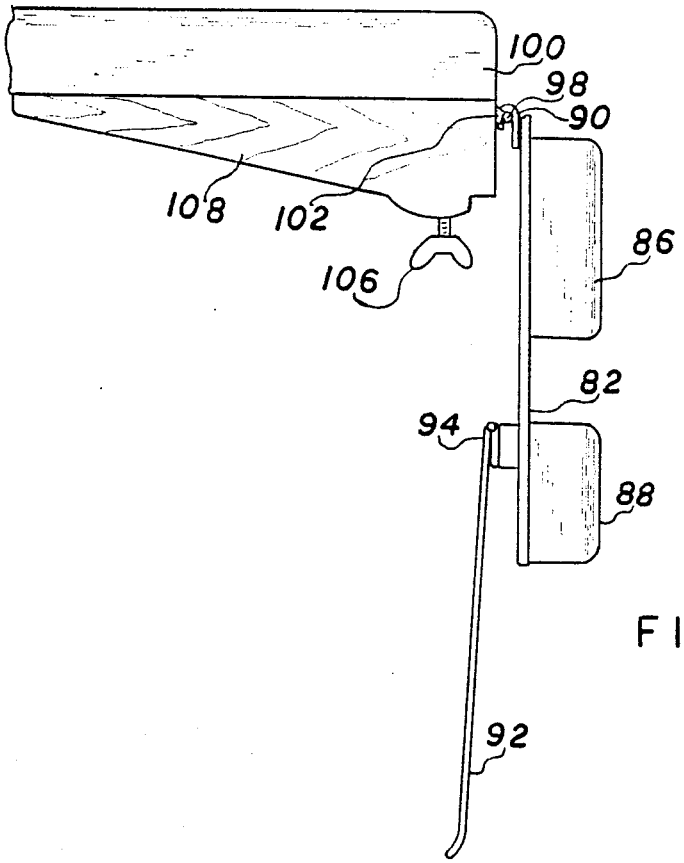

FIG. 5D is a side view showing the face cradle in a partially disassembled, hanging-down position.

Figure 5E:
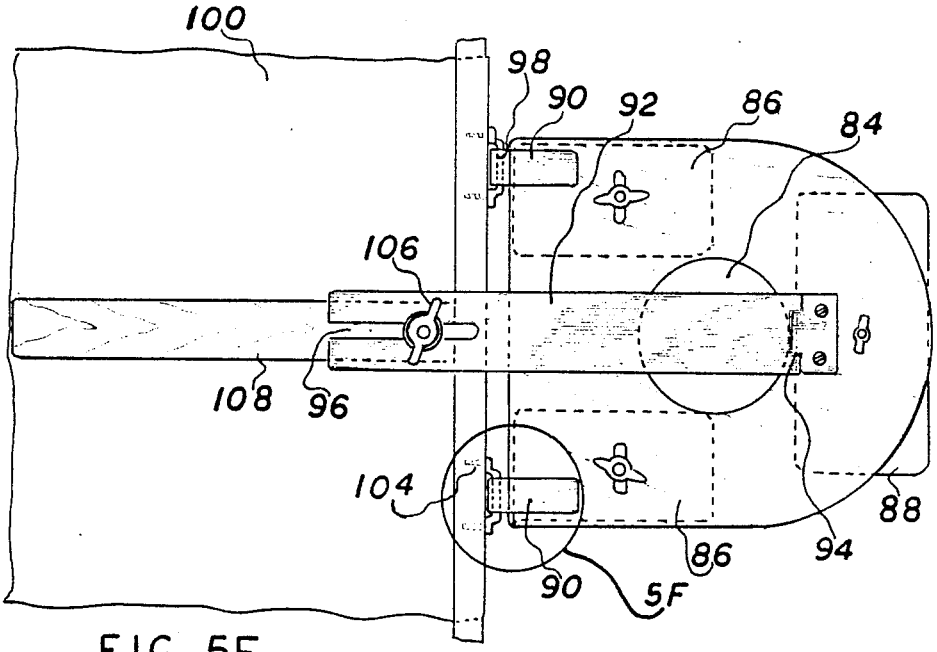

FIG. 5E is a bottom view of the cradle showing certain parts in phantom.

Figure 5F:
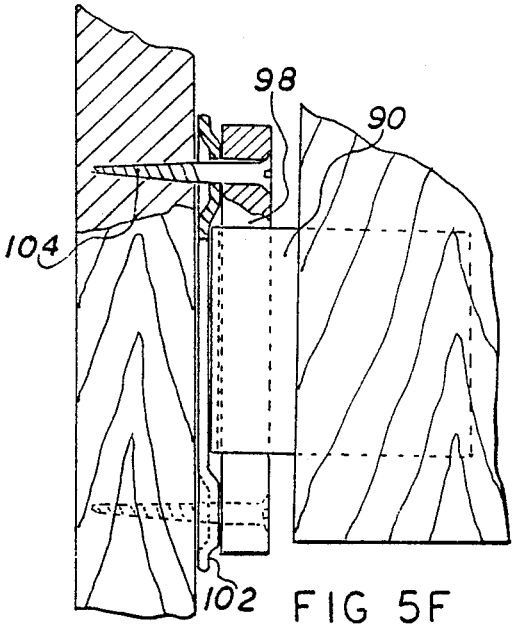

FIG. 5F is a cross-sectional view of the encircled part 5F of FIG. 5E.

Figure 5G:
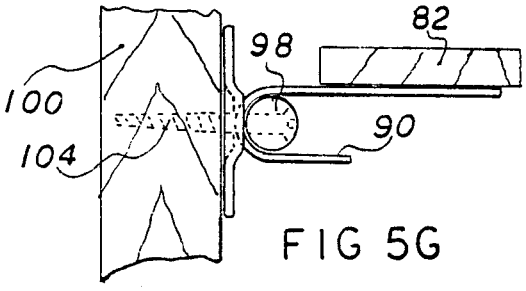

FIG. 5G is a side view of the hinge arrangement of FIG. 5E.

Figure 6A:
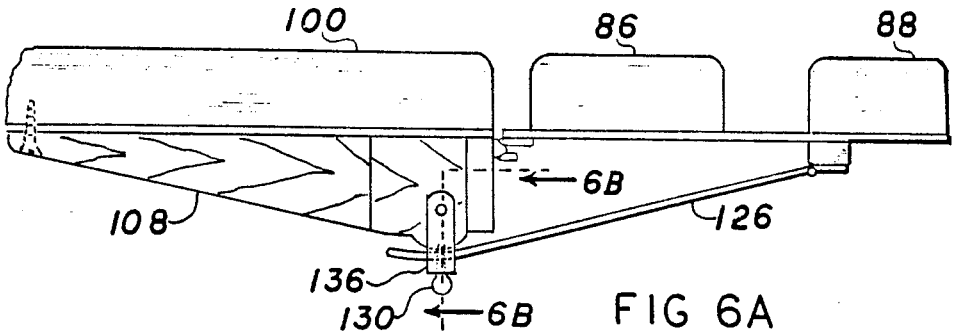

FIG. 6A is a side view of aa alternative face cradle arrangement according to the invention. This arrangement employs a spring pin and pierced arm locking mechanism.

Figure 6B:
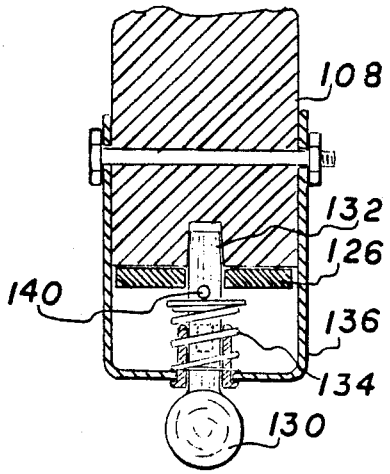

FIG. 6B is a detailed cross-sectional view taken along the lines 6B—6B of FIG. 6A.

Figure 6C:
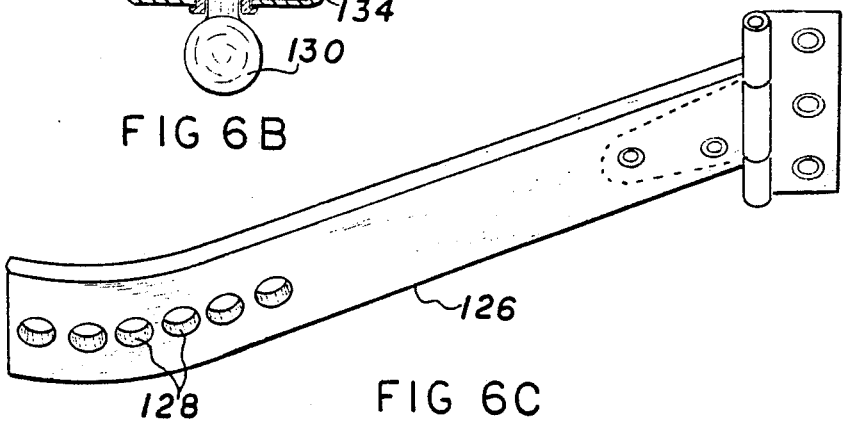

FIG. 6C is a perspective view of the pierced arm of FIG. 6A.

Figure 7A:
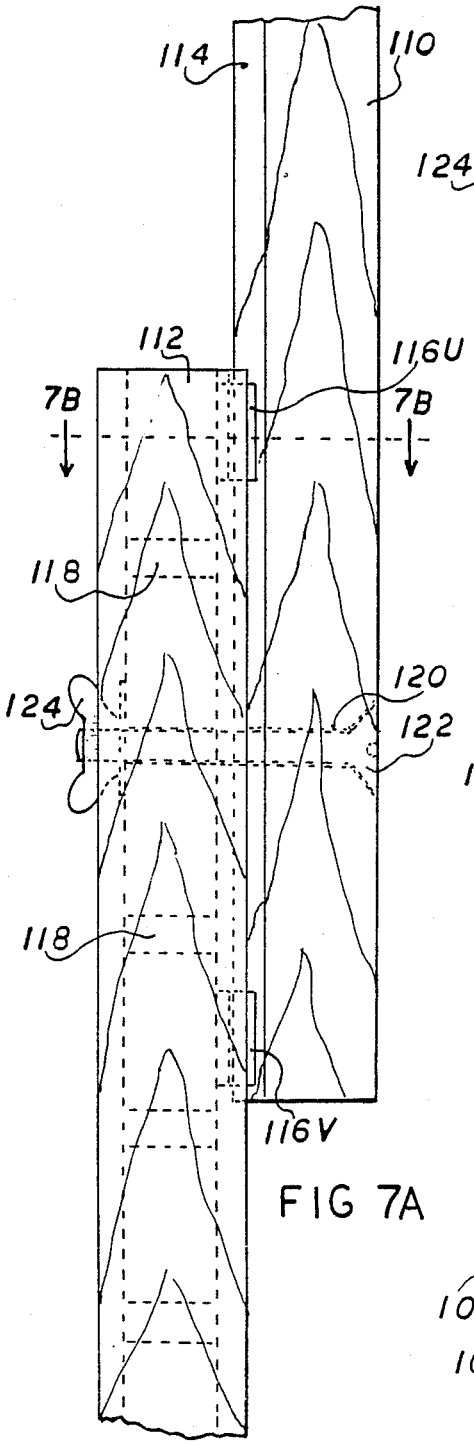

FIG. 7A is a side, phantom view of an adjustable leg arrangement according to the invention.

Figure 7B:
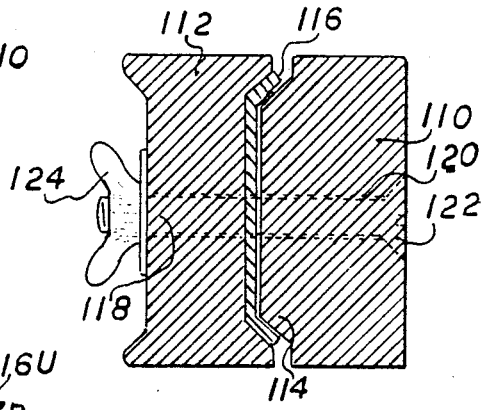

FIG. 7B is a cross-sectional view taken along the lines 7B—7B of FIG. 7A.

Figure 8A:
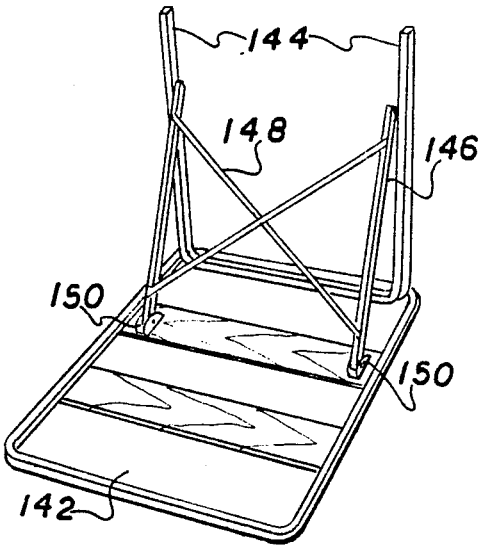

FIG. 8A is a bottom perspective view of an assembled table with an alternative leg locking mechanism employing a rigid brace.

Figure 8B:
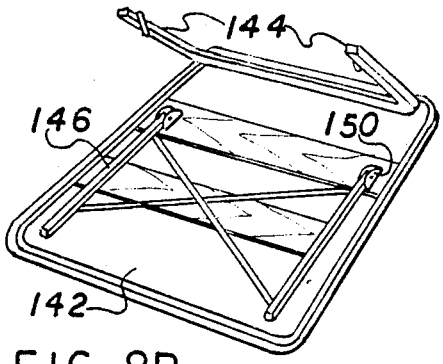

FIG. 8B is a similar view showing the leg and brace partially collapsed.

Figure 8C:
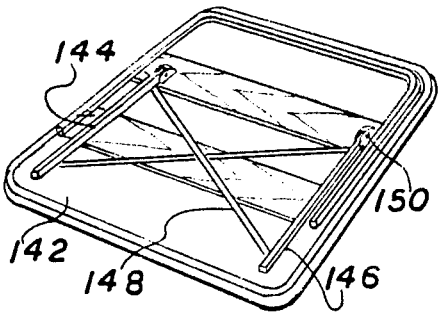

FIG. 8C is a similar view showing the leg and brace fully collapsed.

Figure 8D:
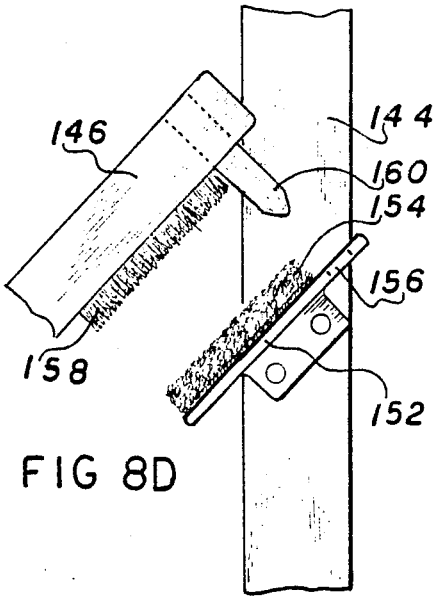

FIG. 8D is a side view of the brace to leg locking mechanism of FIG. 8A in an open condition.

Figure 8E:
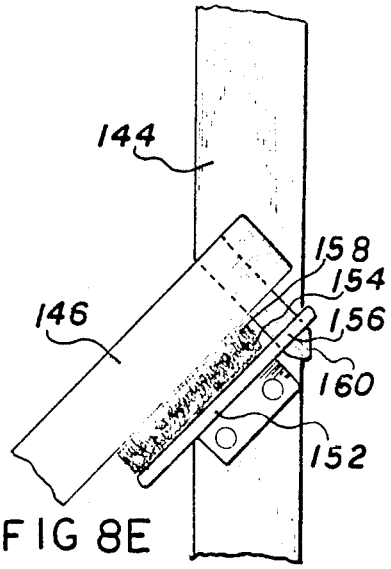

FIG. 8E is a side view of the brace to leg locking mechanism of FIG. 8A in a closed condition.

DRAWING REFERENCE NUMERALS

10 cable stop
12 top section
14 top hinges
15 cable leg hinge
16 leg
18 brace
20 brace top hinge
22 brace bottom hinge
24 brace hinge
26 cable leg
28 cable
30 mating holes
32 brace crosspiece
34 crimped sleeve
36 cable stop washers
38 cable stop spring
40 end panel
41 brace stop
42 cable leg panel
44 cable anchor
46 carrying handle
48 cradle arm holes
50 backup guide
52 closure latch
54 horizontal cable
56 loop and eyelet
58 horizontal cable
60 loop and eyelet
62 secondary cable
64 loop and eyelet
66 loop
68 crimped sleeve
70 legs
72 leg hinges
73 leg stops
74 cable legs
76 cable
78 cable attachment
80 pulley
82 plate
84 central opening
86 cheek pad
88 forehead pad
90 U-hooks
92 slotted arm.
94 hinge
96 slot
98 hinge pin
100 table
102 bracket
104 screw
106 thumbscrew/bolt assy
108 spacer block
110 upper section
112 lower section
114 trapezoidal portion
116 rubber pads
118 holes
120 hole
122 bolt
124 thumbscrew
126 pierced arm
128 holes
130 springed pin assy
132 pin
134 spring
136 U-bracket
140 boss
142 top
144 legs
148 cross struts
150 pivots
152 plate
154 Velcro pase
156 hole
158 Velcro top
160 pin.

DETAILED DESCRIPTION

FIGS. 1A to 1H

Table with V-Cable Arrangement

According to the invention, a collapsible massage table with V-cable arrangement (VCA) is provided with an automatic leg brace locking feature for increased ease of set-up, stability, safety, etc. Prior to discussing the invention table, a review of the prior-art table and its disadvantages will be helpful to show the advantages of the invention more clearly.

Pior-Art Collapsible Massage Table

FIG. 1A

FIG. 1A is a diagrammatic view of a collapsible massage table according to the invention. If parts 10 of the table of FIG. 1A are temporarily ignored, a prior-art table will be illustrated. This prior-art table will be discussed first so that the advantages of the table of the invention can be best understood.

The prior-art table comprises two top sections 12 which are padded and are hingedly interconnected by top hinges, one of which is shown at 14, the other of which is behind hinge 14. The table is supported by four legs, each for a respective corner. The legs are hinged to the outer ends of top sections; only two legs 16 can be seen in FIG. 1A; the other two are hidden. The tops of legs 16 are hingedly connected to the top sections by hinges 17.

Four diagonal leg braces, each for a respective leg, are provided; two are shown at 18. The top end of each brace is hingedly connected to one of top sections 12 at hinge 20 which is spaced slightly out from top hinge 14. The bottom end of each brace 18 is hingedly connected to a near-center part of a respective leg 16 by a bottom hinge 22. Each brace 18 is itself made in two sections which are hingedly connected at 24. A pair of cable-support legs, one of which is shown at 26, are hingedly connected to the center of the top by two hinges, one of which is shown at 15 in FIG. 1C; the cable support legs extend down vertically. A pair of cables, one of which is shown at 28, are connected to form a V-shape as follows: One end of the cable extends diagonally down from the end of the table top near hinge 17, through a horizontal crosspiece (not shown in FIG. 1A but shown at 32 in FIGS. 1B, 1E, 1F, and 1H) which interconnects each pair of braces 18. The cable then continues down to the bottom of cable support leg 26 where it extends through a slot (not shown) in the bottom of the cable leg. The cable then proceeds diagonally up through the other horizontal crosspiece (not shown) to the other end of the table, near the oppostie hinge 17.

When weight is applied to the table, e.g., by a person lying thereon, the weight will tend to push top sections 12 down. This in turn will push down onto legs 16 and cable support leg 26. The force on legs 16 will be transmitted to the floor. The weight on cable leg 26 will push down on the center of cable 28 which will in turn pull against the cable anchors near hinges 17. This pulling action can be broken, according to conventional mechanics, into two resultant forces, a horizontal one which will tend to push the two top sections of the table together, and a vertical one which will push down on legs 16.

To collapse the table, braces 18 are folded up and legs 16 are folded in, as indicated in FIGS. 1D and 1F. To prevent accidental collapse of the table, due, e.g., to an upward kick against hinge 24, braces 18 were provided with locking means to prevent their accidental folding. Such locking means comprised either pins (not shown) inserted into mating holes such as at 30 (FIG. 1D) in the two sections of the brace, a locking latch (not shown) which was set manually, or an automatic locking latch (not shown) which was automatically set when the table was opened.

Disadvantages of Prior-Art Collapsible Massage Table

FIG. 1A

As stated above, the use of these locking means was fraught with disadvantages. They had to be specially inserted or set in place by a separate manual operation. If the user forgot to do this, the stability and the safety of the table was compromised. Also the pins could sometimes be inserted partially and they tended to wear, so that they could not latch, again leading to a compromise in safety. A main disadvantage with latches is that they also had to be set manually, or, if automatic, were heavy, complicated, unreliable, and expensive.

Inventive Improvement

FIG. 1A

According to the invention, a stop 10 is affixed to each cable just up from where the cable passes through the crosspiece, as indicated in FIG. 1A. The stop preferably is a metal sleeve 34 (FIG. 1B) through which the cable passes, and which is crimped to the cable. A pair of cable stop washers 36 are provided between crimped sleeve 34 and crosspiece 32; washers 36 sandwich a helical cable stop spring 38. Cable 28 is made of steel about 3 mm in diameter; spring 38 is a heavy spring about 17 mm long with wire about 1 mm in diameter; and sleeve 34 is about 10 mm long.

Stop 10 improves the stability of the table in the following manner: With the table in assembled condition as shown in FIG. 1A, stop 10 prevents braces 18 and their interconnecting crosspiece 32 from moving upward, along the cable. Thus if a brace 18 is kicked upward, stop 10 will prevent it from folding upward. I.e., the upward force on brace 18 will apply upward force on crosspiece 32 which in turn will apply upward force against stop 10. This force will try to stretch cable 28, but stop 10 will not move because the cable cannot lengthen.

To collapse the table, the user must first tilt it so that it is on its side, as shown in FIG. 1E, whereupon both sections 12 of the top can be folded toward each other about hinge 14, as shown in FIGS. 1D, 1F, and in broken lines in FIG. 1C. This will bring cable anchor points 17 together as indicated in FIG. 1D, causing the cable to slacken. This separates stop 10 from the crosspiece, allowing brace 18 to be folded up, as indicated in FIG. 1D. The braces can be folded up completely and the legs folded in, as indicated in FIG. 1C, whereupon the table can be completely collapsed for easy transport can carrying, as indicated in FIG. 1C.

Note that when upright on its legs (FIG. 1A), the assembled table cannot be folded or collapsed accidentally since stop 10 prevents the leg braces from being folded until the two halves of the top are be folded together to slacken the cable. However since the two halves of the top can't be folded together with the table in upright position, the stop is highly effective in preventing accidental collapse of the table. I.e., neither kicking brace 18 up, nor kicking leg 16 in, nor doing both of these actions simultaneously will be able to collapse the table. In fact, the more weight that is on the table, the less amenable it is to collapse. The table can't be collapsed unless its two upper halves 12 are first folded together and this requires that the table first be rotated so that it is on its side (FIGS. 1E and 1F).

Accordingly, the provision of stops 10 provides increased safety and security, yet at a low cost, with insignificant added weight. The inventive table has increased reliability, greater ease of set-up, increased simplicity, and improved and automatic leg brace locking.

While sleeve 34 per se (FIG. 1B) would block movement of crosspiece 32 and thus provide the advantages of the invention, the provision of spring 38 with sandwiching washers 36 is advantageous since it accommodates any slack caused by tolerance mismatches, wear, etc. I.e., normally spring 38 is slightly compressed when the table is open, thereby providing a slight amount of pressure against crosspiece 32 to hold braces 18 open. However if wear or tolerance allowances cause spring 38 to be slightly separated from the crosspiece, the crosspiece will meet and be blocked from further movement by stop 10 as soon as one attempts to fold brace 18 up. On the other hand, if tolerances are such that sleeve 34 is placed closer than normal to crosspiece 32, the mismatch can be taken up by spring 38.

FIGS. 1A to 1H

General Description of Table

Aside from the provision of stop 10, the construction and operation of the table of these figures is conventional and known and can be gleaned from these figures, which are to general scale. All of the components previously discussed and their interconnections are shown in FIG. 1H, a detailed perspective view of the entire table with the top shown in phantom.

Note that each leg is formed in two mutually slidable sections which are thumbbolted together so that the height of the table can be adjusted. (Alternatively the leg sections can be attached as shown in FIGS 7A and 7B.) The table includes a pair of end panels connected between each pair of legs for strength and for placement of a manufacturer's trademark (not shown). Each brace is formed of two hinged parts and these include a brace stop 41 to prevent the brace from bending down, i.e., in a direction opposite to that indicated in FIG. 1A. Cable support legs 26 are also interconnected by a cable leg panel 42 which adds strength and rigidity. Top sections 12 are fabricated of rectangular wooden frames and wooden rectangular panels which are then padded and covered with vinyl in accordance with well-known practice. Cables 28 are anchored under the top frame to anchor pins or any other suitable anchor 44. Each of cables 28 is also anchored to the bottom of its cable leg 26 by well-known means, e.g., a stop (similar to sleeve 34) crimped onto the cable; the stop fits into a slot in the bottom of the cable leg and is locked in position by a thumb-twistable holder (not shown). A carrying handle 46 is attached to one top section 12.

Further details of the bottom components are shown in FIG. 1E, a bottom view of the table on its side. FIG. 1F shows the table on its side in a partially collapsed condition. Each end of the table includes a pair of grommeted holes 48 and a backup guide 50 for receiving and supporting a pair of arms from a face cradle (not shown) which normally will be positioned beyond the end of the table. As shown in FIG. 1G, the table, after collapse and folding to a compact package, is held in position by a pair of closure latches 52. FIG. 1C shows details of hinge 14 which interconnects top panels 12 and hinge 15 which connects the cable legs to one of the top panels. When the table is collapsed, cable legs 26, which are joined by their panel 42, are folded flat against the right-hand top section 12 to which they are joined. The various parts are joined using conventional woodworker's facilities (screws, dowels, glue, etc.).

While the table is shown as made of wood with a sponge-padded, vinyl-covered top, other materials may be substituted, such as plastic, metal, etc. The invention is not limited to a massage table, but can be used as a paperhanger's table or for any other purpose for which load-bearing tables are used.

FIGS. 2A to 2C

Table with Horizontal Cable on Brace Arrangements

The table of FIGS. 2A to 2C also provides an automatic leg brace locking feature, but in a different way. It is similar to the table of FIGS. 1 except that, instead of a center cable leg and a V-shaped cable arrangement, it employs a horizontal cable-to-brace arrangement (HCBA).

The table top sections 12, legs 16, and upwardly-foldable braces 18 are similar to that of FIGS. 1. The braces also have brace stops 41 and hinges 24 (FIG. 2C). However, instead of the V-shaped cable arrangement and center cable leg, the HCBA table employs a horizontal cable 54 interconnected between the lower halves of each leg brace 18 by a loop and eyelet arrangement, as illustrated at 56 in FIG. 2C. Two identical cables are provided, one for each leg brace, but only the front one can be seen in FIGS. 2.

The table of FIGS. 2 operates as follows. When it is fully open and upright, as shown in FIG 2A, braces 18 cannot be folded up since cable 54 will prevent any upward movement of the lower half of each brace.

To collapse the table, cable 54 must first be allowed to slacken. This is accomplished in the same manner as with the table of FIGS. 1. The table is first laid on its side and then two top sections 12 are folded together, as illustrated in FIG. 2B, a view of the side of the table, i.e., a top view of the table on its side. This brings the two sets of legs at each end of the table together, causing each cable 54 to slacken, as illustrated for the front cable. Then brace 18 can be folded up as shown in FIGS. 1D and 1F.

The table of FIGS. 2 does not require any center legs, yet still provides an automatic brace locking feature since the braces can't be folded unless the two top sections of the table are first partially folded together. In fact, as with the table of FIGS. 1, the more weight that is put on the top of the table, the more securley braces 18 are locked since when the table is upright, the difficulty of folding the two top sections of the table together is proportional to the weight on the table's top.

FIGS. 3A to 3C

Table with Horizontal Cable on Leg Arrangement

The table of FIGS. 3A to 3C also provides an automatic leg brace locking feature, but in a different way. It is similar to the table of FIGS. 1 except that, instead of a center cable leg and a V-shaped cable arrangement it employs a horizontal cable-to-leg arrangement (HCLA).

The table's top sections 12, legs 16, and upwardly-foldable braces 18 are similar to those of FIGS. 1. The braces also have brace stops 41 and hinges 24 (FIG. 3C). However, instead of the V-shaped cable arrangement and center cable leg, the HCA table employs a horizontal cable 58 interconnected between the lower halves of each leg 16 (about 0.25 of the way up from the floor) by a loop and eyelet arrangement, as illustrated at 60 in FIG. 3C. Two identical cables 58 are provided, one for each leg brace, but only the front one can be seen in FIGS. 3.

Connected between a point near each end of horizontal cable 58 and the lower half of each brace 18 is a secondary cable 62. Two secondary cables 62 are provided for each horizontal cable, so that a total of four secondary cables are provided for the entire table. When the table is upright (FIG. 3A), the upper end of each secondary cable is joined (by a loop and eyelet arrangement 64—FIG. 3C) to the lower half of each brace near the brace hinge 24 at a right angle to the brace. The lower end of each secondary cable is joined to horizontal cable 58 by a loop 66 (FIG. 3C) which extends around cable 58 or by means of a crimped device with two holes which clamp the respective cables. A crimped sleeve 68, which is similar to crimped sleeve 34 (FIG. 34), prevents loop 66 from moving toward the end of the cable.

The table of FIGS. 3 operates as follows. When it is fully open and upright, as shown in FIG. 3A, braces 18 cannot be folded up since cables 58 and 62 will prevent any upward movement of the lower half of each brace. I.e., when force is applied upwardly on brace 18, this force will be, applied to the upper end of secondary cable 62. This tensioning of cable 62 will pull upwardly at the point of connection of cable 62 to cable 58, tending to pull upwardly and bend and shorten cable 58.

To collapse the table, cable 58 must first be allowed to slacken. This is accomplished in the same manner as with the table of FIGS. 1. The table is first laid on its side and then two top sections 12 are folded together as illustrated in FIG. 2B, a view of the side of the table, i.e., a top view of the table on its side. This brings the two sets of legs at each end of the table together, causing each cable 54 to slacken, as illustrated for the front cable. Then brace 18 can be folded up as shown in FIGS. 1D and 1F.

The table of FIGS. 3 does not require any center legs, yet still provides an automatic brace locking feature since the braces can't be folded unless the two top sections of the table are first partially folded together. In fact, as with the table of FIGS. 1, the more weight that is put on the top of the table, the more securely braces 18 are locked since the table is upright, the difficulty of folding the two sections of the table together is proportional to the weight on the table's top.

In lieu of connecting horizontal cable 58 in the position indicated by the solid lines (about 0.25 of the length of the leg up from the floor) the cable can be connected adjacent the floor, between the bottoms of the legs, as illustrated at 58'. Secondary cables 62' are made longer, as illustrated. In this version, the table can be more readily used by a sitting massager since the horizontal cable will not interfere with the massager's legs.

FIGS. 4A to 4C

Table with Spread-Leg Arrangement

The table of FIGS. 4A to 4C has no leg braces. Thus it locks in an open condition in a different way, namely by using cables. Specifically, it uses a spread-leg arrangement of cables and short cable legs. The table's top sections 12 are similar t those of FIGS. 1. Its legs 70 are slightly spread outwardly and are hingedly connected to the top sections by hinges 72 (details in FIG. 4C). As shown in FIG. 4C, leg stop 73 prevents the legs from folding outwardly farther than as shown. One leg stop 73 is provided at each end of the table. A pair of short cable legs, the front one of which can be seen at 74, extend down from the center of the table, similar to the cable legs of the FIG. 1 embodiment.

Two cables (only the front one 76 can be seen) are each connected in a V-shaped arrangement as follows: Starting from the left, one end of the cable is attached to leg 70 at attachment point 78 (FIG. 4C), about 0.6 (or more or less depending upon the design) of the way up from ground level. From there the cable proceeds up and out to a pulley 80 under the end of the table. The cable is bent almost 180° around pulley 80 and then extends toward the center and slightly down (on one side of leg 70) to the bottom of cable leg 74. Preferably cable 76 is connected to the bottom of cable leg 74 in the same manner as in FIGS. 1. Then the cable proceeds up, in a mirror image of its lefthand arrangement, past leg 70, over righthand pulley 80, to righthand attachment 78.

The table of FIGS. 4 operates as follows: When it is fully open and upright, as shown in FIG. 4A, weight applied to the top of the table will press down on legs 70 and cable leg 74. The weight on cable legs 74 will tension cable 76, causing force to be applied to attachment points 78, pulling upwardly and outwardly on legs 70. However, as stated, legs 70 will not be able to fold or rotate outwardly farther than shown because of stops 73. Thus the weight on the table's top will not be able to push cable legs 74 down. In accordance with the invention, legs 70 will not be able to be folded inwardly when the table is upright since cable 76 will be tensioned and thereby prevent inward folding of the legs. Again, when more weight is applied to the table's top, legs 70 will be less able to fold.

To collapse the table, cable 76 must first be allowed to slacken. This is accomplished in the same manner as with the table of FIGS. 1. The user first lays the table on its side (FIG. 4B shows a top view of the table on its side) and then folds two top sections 12 together, as illustrated. This brings pulleys 80 together, causing cables 76 to slacken, as illustrated. Then the user can fold legs 70 in, as illustrated for the righthand leg in FIG. 4B.

The table of FIGS. 4 does not require any braces, yet still provides an automatic leg locking feature since the legs can't be folded unless the two top sections of the table are first partially folded together.

FIGS 5A to 5G

Hinged, Adjustable Face Cradle with Thumbscrew and Slotted Arm

Conventionally, face cradles comprised a plate or board with a central opening 84 (FIG. 5E), a pair of parallel cheek pads 86, and a forehead pad 88. Usually the person being massaged, when lying prone (face down), put his or her face into the space between the pads and breathed through the central opening. The plate usually has a pair of parallel legs extending therefrom and parallel to the plate; these (not shown) were usually tubular supports which were inserted into holes, such as 48 (FIG. 1F), to support the face cradle adjacent the end of the table.

As noted above, this type of arrangement had numerous disadvantages. The assembly was large, awkward, heavy, difficult to assemble, and could not be postioned other than horizontally.

According to the present invention, a removable, hooked-on face plate 82 is provided; it can be easily removed and reattached to the table and can be adjusted in a variety of positions, from horizontal (FIG. 5A) to tilted up (FIG. 5B), to tilted down (FIG. 5C).

The end of plate 82 adjacent the table has a pair of U-shaped sheet metal hooks 90 attached thereto. Hooks 90 extend from plate 82, as indicated best in FIG. 5F and 5G. Also one end of an elongated, slotted arm or tongue 92 is hingedly attached adjacent the opposite end of plate 82 by a hinge 94 (FIG. 5E). The other end or arm 92 has an open slot 96 therein. Arm 92 is generally straight, but the free end thereof is bent up slightly, as indicated in FIGS. 5A to 5C.

Hooks 90 mate with a pair of hinge pins 98 which are attached to the end of table 100 by a bracket or base plate 102. Bracket 102 has a flat central portion which rests against the table's end and a pair of bent-out end sections against which the ends of pin 98 are held; these end sections hold each pin 98 away from table 100 and the central portion of the bracket so that each U-hook 90 can be hooked around a respective pin. The bracket and pin assembly is held together and is attached to the end of the table by a pair of screws 104, as shown.

Arm 92 mates with a thumbscrew and bolt assembly 106 which is in turn attached to a spacer block 108 under the end of table 100. Spacer block 108 is generally wedge shaped, sloping gradually down from its narrowest point at the left to a maximum depth of about 15 cm high adjacent the right end of the table. It has a curved bottom so as to mate with the curved end of arm 92. As indicated best in FIG. 5E, slot 96 of arm 92 is engaged with the bolt of thumbscrew-bolt assembly 106.

In operation, the face cradle is assembled to the table by first engaging hooks 90 around respective pins 98, as indicated in FIG. 5D. In this position the cradle hangs straight down and its arm 92 also hangs down, out of the way. Thus this position can be used for inactive storage of the cradle.

Next the cradle is rotated to an upward angle, higher than that shown in FIG. 5B, and slot 96 of arm 92 is engaged with the bolt of the thumbscrew assembly. The cradle is then lowered to the horizontal position as indicated in FIG. 5A and the thumbscrew is tightened to lock the cradle in position. If the massager wants to have the head of the person being massaged tilt down or up, either of the alternative positions of the cradle as indicated in FIGS. 5B and 5C can be employed by loosening the thumbscrew, adjusting the cradle, and retightening the thumbscrew.

Note that the face cradle assembly is simple in construction, lightweight, compact, easy to remove and assemble, and can be adjusted to a slanted up or down position.

FIGS. 6A to 6C

Face Cradle with Springed Pin and Pierced Support Arm

In lieu of the slotted support arm and thumbscrew arrangement of FIGS. 5, the springed pin and pierced support arm arrangement of FIGS. 6A to 6C can be employed. All parts are identical to the embodiment of FIGS. 5, except that in lieu of a slotted arm, a pierced arm 126 having a series of holes 128 adjacent the free end thereof is provided and in lieu of a thumbscrew grasp, a spring loaded locking pin 130 is provided. The face cradle is used in the same manner except that arm 126 is locked by pin 130 instead of the thumbscrew. This is accomplished by pulling down pin head 130 against the force of spring 134; pin 130 has a rounded head for ease of grasping. Then arm 126 is inserted into U-bracket 136, and pin 130 is released. The cradle and attached arm 126 is then adjusted to the desired position. Arm 126 will move within the U-bracket. When the desired position of the face cradle is obtained, pin 130 is released and arm 126 is then adjusted slightly until pin 130 falls into one of holes 128 as indicated in FIG. 6B, thereupon locking the cradle in position.

The assembly is attached to projecting spacer block 108 under the bottom of table 100. U-bracket 136 is bolted onto support 138 as indicated. The shaft 132 of pin 130 is urged upward by spring 134 which presses between the bight section of bracket 136 and a boss 140 on shaft 132. A guideway for the pin is provided on the bight section of the bracket and a barb is provided on the shank of the pin to prevent it from being removed from its bracket. The bracket may also contain barbs on its legs (not shown) for grasping spacer 108 to prevent the bracket from rotating.

FIGS. 7A and 7B

Adjustable Leg Arrangement

An improved means of adjusting the length of the table's legs, and hence the height of the table, is illustrated in FIGS. 7A and 7B.

The adjustable legs each have two sections, an upper section 110 and a lower section 112. The sections are keyed together, i.e., each section is designed to mate with the other and to slide axially in the other. Upper leg 110 has a generally rectangular shape, as indicated by the cross-sectional view in FIG. 7B, except that the left side thereof has a projecting portion 114 which is trapezoidal in section and is elongated for the length of the section. Lower section 112 has a serified "I" shape in cross section, either side of which is designed to conformingly mate with trapezoidal portion 114. Lower section 112 has an upper rubber pad 116U glued adjacent its upper end and upper section 110 has a lower rubber pad 116L glued adjacent its lower end. Lower section 112 also has a plurality of holes 118 drilled therethrough at spaced locations, as indicated, and upper section 110 has a single hole 120 drilled therethrough. Hole 120 is countersunk and a single threaded bolt 122 and mating thumbscrew 124 is passed through aligned holes in both leg structures.

In operation, the length of each leg can be easily adjusted by removing thumbscrew 124, removing bolt 122, and sliding the two leg sections to the desired new length such that hole 120 in upper section mates with one of holes 118 in the lower section. Bolt 122 is then reinserted and thumbscrew 124 is then retightened. Some deformation of the leg sections will occur when the thumbscrew is tightened due to the separation between leg sections provided by the rubber pads.

The use of the conformingly mating legs, together with the spaced rubber pads, which have a high coefficient of friction and which allow the legs to deform when the thumbscrew is tightened, enables the legs to be firmly held with a single nut and bolt. The length of the legs can be adjusted quickly without tools in a reliable, simple, and rapid manner. The positioning of the pads at the ends of their respective legs allows the legs to be moved with a maximum of relative travel.

In lieu of attaching the two pads to the respective leg sections, they can be attached to the upper section, or can even be free. Any resilient material other than rubber can be used, such as cloth, plastic, wood, silicone, etc. The projection can be on either leg section and can have shapes other than trapezoidal, e.g., half round, rectangular, triangular, etc.

FIGS. 8A to 8E

Table with Foldable Legs and Foldable, Attachable Brace

FIGS. 8A to 8E show another means of rigidly supporting the legs of the table in open position. The table has a top 142, a set of four legs, only two of which are shown at 144, and a brace 146. Legs 144 comprise a U-shaped assembly, the bight section of which is hingedly attached to top 142 by hinges (not shown). Brace 146 comprises a pair of arms which are shorter than the legs and which are rigidly held by cross struts 148. The arms are pivotably joined to a cross support under top 142 at 150 at locations spaced about 0.15 of the length of the table's top from the bight portion of legs 144. (Two more legs, similar to legs 144, and a brace, similar to brace 146, are provided at the other end of the table's top, but are not shown so that the illustrated set can be seen clearly.)

The free ends of the brace's legs are attached to legs 144 at a location about 0.25 of the length of the legs from the floor by respective pin-in-socket and multiple hook and eyelet arrangements (sold under the trademark VELCRO), as illustrated in FIGS. 8D and 8E. A plate 152 is attached in a slanted manner to each of legs 144 and one half of the Velcro attachment 154 is glued to plate 152. Also, plate 152 has a hole 156 therethrough.

A mating half 158 of the Velcro attachment is glued to the end of each arm of brace 146. Also a pin 160 is also attached normally to the end of the arm.

All parts are sized and arranged so that when legs 144 are normal to the top and brace 146 is brought into contact with the legs, the two halves of the Velcro attachment will mate in a parallel manner and pin 160 will enter hole 156 directly, as shown in FIG. 8E.

To assemble the table from the collapsed condition of FIG. 8C, the legs are first opened (FIG. 8B) and then the brace is opened and mated with the legs, as shown. The Velcro attachment will keep the brace from rotating away from the legs and the pin-in-hole arrangement will keep the legs from rotating from the normal position. The table can be quickly collapsed by breaking the Velcro attachment and then folding in the brace and legs.

The leg support method of FIGS. 8 is lightweight, reliable, economical, and very easy to use. Since the legs have no cross members, and since about 0.7 of the table's length is clear between the legs and their arm braces, a massager can sit at either the side or the end of the table and no portion of the table will interfere with the massager's knees.

Alternatively the pin and hole can be interchanged and multiple pins and holes can be used. Legs 144 can be joined by bracing, or they can be independently hinged, along with arms 146.

SUMMARY, RAMIFICATIONS, AND SCOPE

Readers will see that, according to the invention, several types of weight-bearing, yet collapsible tables and face cradles therefor are provided. These all have automatic or easy-to-use leg or leg brace locking features which operate in an economical, reliable, and lightweight manner.

All of the cable embodiments consist of a collapsible table with two hingedly interconnected top sections. Each top section 12 has two major surfaces, one being an undersurface and the other being a top surface. One edge of each top section is joined to one edge of the other top section by hinge means arranged to enable the top sections to be either folded together in a collapsed position (FIG. 1G) so that their undersurfaces face each other, or folded apart to an upright condition so that their undersurfaces are coplanar (FIG. 1H). Each table also has two pairs of legs, each leg 16 comprising an elongated member, each pair hingedly joined to the underside of a respective top section at two spaced locations remote from the hinged edge. Each pair of legs is joined to the underside of its top section by pivots or hinges which enable each pair of legs to folded to either a collapsed position so that they lie parallel and adjacent to their underside surface, or an upright position so that they extend out from their underside surface. Each table also has means (the cables, cable legs, braces, etc. for locking the two pairs of legs in their upright position so that they cannot be folded in to their collapsed position when the top surfaces are in their upright, coplanar condition, and so that the legs can be folded to their collapsed condition so as to lie parallel to their underside surface when the top sections are folded at least partially together, toward their collapsed condition.

While the above description contains many specificities, these should not be construed as limitations on the scope of the invention, but as exemplifications of the presently-preferred embodiments thereof. Many other ramifications and variations are possible within the teachings of the invention. For example, different materials than those suggested can be used, the cables of FIG. 1 can extend through the legs per se if the leg crosspieces are eliminated, the top of the table can be a flat board, other types of face cradle arm attachments can be used, other types of fastening means can be used than shown in FIG. 8D, etc. Thus the scope of the invention should be determined by the appended claims and their legal equivalents, and not by the examples given.

We claim:

1. A collapsible table, comprising:

A. two hingedly interconnected top sections, each top section having two major opposing surfaces which face in opposite directions, one opposing surface being an undersurface and the other opposing surface being a top surface, one edge of each top section being joined to one edge of the other top section by hinge means arranged to enable said top sections to be:

(a) folded together in a collapsed condition so that their undersurfaces face each other, and (b) folded apart to an open condition so that their undersurfaces are coplanar, B. two pairs of legs, each leg of each pair comprising an elongated member, each pair of legs being hingedly joined to the undersurface of a respective top section at two locations which are spaced from each other and which are remote from said one edge of said respective top section, each pair of legs being joined to the undersurface of its top section by hinge means arranged to enable each pair of legs to folded to:

(a) a collapsed condition so that said legs lie parallel and adjacent to the undersurface of their top section, and (b) an open condition so that they extend out from the undersurface of their top section, and C. four elongated leg braces, each of said braces having two opposite ends and comprising two parts which are hinged at a location between said ends so that said parts can be:

(a) folded together in one direction to a parallel, side-by-side condition, or (b) unfolded and opened to a coaxial condition, D. each brace being connected between one of said legs and its respective top section such that when said braces are opened to their coaxial condition, they will hold said legs in their open condition, and when said braces are folded together, said legs will be in their collapsed condition, and E. brace-holding means comprising:

(a) a brace-stop member on one of said two parts of each of said braces for preventing the parts of each respective brace from being folded together in a direction opposite to said one direction, toward a parallel, side-by-side condition, and (b) a pair of flexible cables, each of said cables being connected to said leg braces and to said top sections, said brace-holding means, including said cables and their respective stop members, being arranged to:

(1) hold said leg braces in their coaxial condition so as to prevent said braces from folding to their parallel, side-by-side condition in response to said top surface being in their open, coplanar condition, and (2) allow said braces to be folded in said one direction, away from their coaxial condition toward their collapsed condition in response to said top sections being folded at least partially together, toward their collapsed condition, and (c) a pair of cable support legs extending down from an area adjacent said one edge of one of said top sections, each cable of said pair of cables being connected between a part of each top section remote from said one edge thereof, a center part of each cable passing over the end of a respective cable support leg remote from its point of connection to said one top section, said cables being arranged so that they are taut when said table is in an open condition and said leg braces are in their coaxial condition.

2. The table of claim 1 wherein said brace-holding means also comprises a crosspiece interconnecting each pair of legs, each cable passing through both crosspieces, and a stop member on each cable adjacent each crosspiece.

3. The table of claim 2 wherein said stop member comprises a sleeve crimped to its cable and springably-compressible means affixed to its cable between said sleeve and an adjacent crosspiece.

4. The collapsible table of claim 1 wherein said cables are connected so that one end of each cable is connected to a part of each leg brace adjacent the leg to which said brace is connected, the other end of each cable being connected to the corresponding part of an opposing leg brace.

5. The collapsible table of claim 1 wherein one end of each cable is connected to a part of each leg adjacent the to where said brace is connected, the opposite end of each being connected to the corresponding part of the opposite leg, said cables being arranged so that they are taut when said table is in an open condition and said legs are in their open condition, and two pairs of secondary cables, each secondary cable being connected between one part of a respective brace and one of said cables of said first pair of cables.

6. A collapsible table, comprising:

A. two hingedly interconnected top sections, each top section having two major opposing surfaces which face in opposite directions, one opposing surface being an undersurface and the other opposing surface being a top surface, one edge of each top section being joined to one edge of the other top section by hinge means arranged to enable said top sections to be:

(a) folded together in a collapsed condition so that their undersurfaces face each other, and (b) folded apart to an open condition so that their undersurfaces are coplanar, B. two pairs of legs, each leg comprising an elongated member, each pair of legs being hingedly joined to the undersurface of a respective top section at two locations which are spaced apart and which are remote from said one edge thereof, each pair of legs being joined to the undersurface of its top section by hinge means arranged to enable each pair of legs to folded to:

(a) a collapsed condition so that said legs lie parallel and adjacent to the undersurface of their top section, and (b) an open condition so that they extend out from the undersurface of their top section, and C. locking means, responsive to the condition of said top sections, for:

(a) locking said two pairs of legs in their open condition so as to prevent them from being folded in to their collapsed condition in response to said top surfaces being in their open, coplanar condition, and (b) allowing said legs to be folded to their collapsed condition so as to allow each pair to lie parallel to the undersurface of their top section in response to said top sections being folded at least partially together, toward their collapsed condition, D. said locking means comprising:

a pair of cable support legs extending down from an area adjacent said one edge of one of said top sections, four elongated leg braces, each comprising two parts which are hinged together at a location between the opposite ends of said braces and which are (a) foldable together in one direction to a parallel, side-by-side condition and (b) openable to a coaxial condition, each brace connected between one of said legs and its respective top section, four brace-stop members, one brace-stop member on one of said two parts of each of said braces for preventing the parts of each respective brace from being folded together in a direction opposite to said one direction, toward a parallel, side-by-side condition, a pair of cables, one end of each connected between a part of each top section remote from said one edge thereof, a center part of each passing over the end of a respective cable support leg remote from its point of connection to said one top section, said cables being arranged so that they are taut when said table is in an open condition and said leg brace parts are coaxial, and brace-holding means for holding said hinged parts of said leg braces in their coaxial condition in response to said cables being taut.

7. The table of claim 6 wherein said brace-holding means comprises a crosspiece interconnecting each pair of legs, each cable passing through both crosspieces, and a stop member on each cable adjacent each crosspiece.

8. The table of claim 7 wherein said stop member comprises a sleeve crimped to its cable and springably-compressible means affixed to its cable between said sleeve and the adjacent crosspiece.

9. A collapsible table, comprising:

A. two hingedly interconnected top sections, each top section having two major opposing surfaces which face in opposite directions, one opposing surface being an undersurface and the other opposing surface being a top surface, each top section having an inner edge at one end thereof and an outer edge at the opposite end thereof, the inner edge of each top section being joined to the inner edge of the other top section by hinge means arranged to enable said top sections to be:
(a) folded together in a collapsed condition so that their undersurfaces face each other, and
(b) folded apart to an open condition so that their undersurfaces are coplanar, B. two pairs of legs, each leg comprising an elongated member, each pair of legs being hingedly joined to the undersurface of a respective top section at two locations which are spaced apart and which are remote from said one edge thereof, each pair of legs being joined to the undersurface of its top section by hinge means arranged to enable each pair of legs to folded to:
(a) a collapsed condition so that said legs lie parallel and adjacent to the undersurface of their top section, and
(b) an open condition so that they extend out from the undersurface of their top section, C. each pair of legs being joined to its respective top section at locations closer to said outer edge of said top section than said inner edge thereof, said legs extending from said top sections at greater than a right angle, D. locking means, responsive to the condition of said top sections, for
(a) locking said two pairs of legs in their open condition so as to prevent them from being folded in to their collapsed condition in response to said top surfaces being in their open, coplanar condition, and
(b) allowing said legs to be folded to their collapsed condition so as to allow each pair of legs to lie parallel to the undersurface of their top section in response to said said top sections being folded at least partially together, toward their collapsed condition, E. said locking means comprising a pair of cable support legs extending down from an area adjacent said inner edges of said top sections, and a pair of cables, one end of each connected to a respective leg, the other end of each being connected to the corresponding part of the opposite leg, a center part of each cable passing over the end of a respective cable support leg remote from its point of connection to the top sections of said table, each cable extending out, from its point of connection with its respective leg, to a pulley attached to the undersurface of a top section at the end of said top section opposite said one end thereof, and thence in to its cable support leg, said cables being arranged so that they are taut when said table is in an open condition and said top sections are coplanar.

* * * * *

UNITED STATES PATENT AND TRADEMARK OFFICE

CERTIFICATE OF CORRECTION

PATENT NO. : 4,833,998

DATED : May 30, 1989

INVENTOR(S) : Everett, J. E., and Tuhtan, M. J.

It is certified that error appears in the above-identified patent and that said Letters Patent is hereby corrected as shown below:

Col. 9, line 26, after "since" insert --when--.

Col. 9, actual line 43 (numbered line 45) change "t" to --to--.

Signed and Sealed this

Sixth Day of February, 1990

*Attest:*

JEFFREY M. SAMUELS

*Attesting Officer*

*Acting Commissioner of Patents and Trademarks*